US006030263A

United States Patent [19]

Uchino et al.

[11] Patent Number: 6,030,263

[45] Date of Patent: Feb. 29, 2000

[54] HYDROPLANE

[75] Inventors: Takaaki Uchino, Hamamatsu; Junzo Ueda, Shizuoka-ken; Yasuaki Yatagai, Hamamatsu, all of Japan

[73] Assignee: Suzuki Motor Corporation, Shizuoka-ken, Japan

[21] Appl. No.: 09/119,689

[22] Filed: Jul. 21, 1998

[30] Foreign Application Priority Data

Sep. 9, 1997 [JP] Japan ..... 9-244282

[51] Int. Cl.[7] ..... B63H 21/32

[52] U.S. Cl. ..... 440/89

[58] Field of Search ..... 440/38, 88, 89; 114/55.5

[56] References Cited

U.S. PATENT DOCUMENTS

| | | | |
|---|---|---|---|
| 4,997,399 | 3/1991 | Nakayasu et al. | 440/88 |
| 5,212,949 | 5/1993 | Shiozawa | 60/298 |
| 5,647,779 | 7/1997 | Nanami | 440/38 |

FOREIGN PATENT DOCUMENTS

| | | |
|---|---|---|
| 7-237586 | 9/1995 | Japan . |
| 7-237587 | 9/1995 | Japan . |
| 7-237588 | 9/1995 | Japan . |
| 8-26185 | 1/1996 | Japan . |
| 8-49596 | 2/1996 | Japan . |
| 8-53098 | 2/1996 | Japan . |

*Primary Examiner*—Ed Swinehart
*Attorney, Agent, or Firm*—Darby & Darby

[57] ABSTRACT

A hydroplane has a four-cylinder, four-cycle engine and a jet pump mounted in the hull. The cylinders of the four-cylinder engine each have an individual exhaust manifold pipe connected to the exhaust port from each cylinder, and the multiple exhaust manifold pipes are put together at the downstream end to form a single outlet. This outlet and an exhaust pipe from the muffler is connected by a joint pipe.

12 Claims, 5 Drawing Sheets

HYDROPLANE

BACKGROUND OF THE INVENTION

1. Field of the Invention

The present invention relates to a hydroplane that is propelled by the jet of water ejected rearward by the rotation of an impeller.

2. Description of the Prior Art

A typical small-type hydroplane has a two-cycle engine and a jet pump (both not illustrated) mounted in its hull and can move in the predetermined direction by driving the two-cycle engine so as to power the jet pump. The reason for the mounting of a two-cycle engine in the hull is based on the fact that it needs neither an oil pan mechanism nor valve gear mechanism and it is of light weight and compact and can produce a high specific power, all of these features making it suitable for small-type hydroplanes.

However, a two-cycle engine has a large fuel consumption and exhausts a large amount of hydrocarbons (to be abbreviated as HCs hereinbelow) so that it is not a good way to respond to requests for prevention of air, river, lake and sea pollution. In recent years, four-cycle engines, which have a reduced fuel consumption and exhaust a lower amount of HCs, have been developed and improved by raising the revolution speed, increasing the engine displacement and using a multicylinder configuration in order to ensure output power comparable to that of two-cycle engines as well as to prevent environmental pollution. In particular, the effect of raising the revolution speed of four-cycle engines, has made the realization of compact, light-weight, high power four-cycle engines possible.

Prior art concerning hydroplanes of this type are found in Japanese Patent Application Laid-Open Hei 7 No.237,586, Japanese Patent Application Laid-Open Hei 7 No.237,587, Japanese Patent Application Laid-Open Hei 7 No.237,588, Japanese Patent Application Laid-Open Hei 8 No.26,185, Japanese Patent Application Laid-Open Hei 8 No.49,596 and Japanese Patent Application Laid-Open Hei 8 No.53, 098.

As stated above, the conventional hydroplanes use four-cycle engines which have been developed and improved by raising the revolution speed and increasing the engine displacement and by using a multicylinder configuration in order to ensure output power comparable to that of two-cycle engines. In this case, the exhaust system heavily affects the output power, and hence needs a very complicated shape and configuration in order to meet the required performances. Accordingly, it has been very difficult to produce a light-weight, compact exhaust system for it.

SUMMARY OF THE INVENTION

The present invention has been devised in view of the above conventional problems, and it is therefore an object of the invention to provide a hydroplane in which a light-weight, compact exhaust system can be configured even using a four-cycle engine.

In order to achieve the above object, the present invention is configured as follows:

In accordance with the first aspect of the invention, a hydroplane comprises an engine and a jet pump mounted in the hull to propel itself by running the engine to power the jet pump, and is characterized in that the engine is of a multicylinder, four-cycle type and the cylinders each have an individual exhaust manifold pipe connected to the exhaust port of each cylinder, and the multiple exhaust manifold pipes are put together at the downstream end to form a single outlet.

In accordance with the second aspect of the invention, the hydroplane having the above first feature is characterized in that each of the exhaust manifold pipes has a double pipe configuration of inner and outer tubes, between which partitioned passages for the flow of cooling fluid are formed.

In accordance with the third aspect of the invention, the hydroplane having the above first feature is characterized in that the outlet and an exhaust pipe connected to the muffler is joined by a joint member.

In accordance with the fourth aspect of the invention, the hydroplane having the above second feature is characterized in that each of the exhaust manifold pipes has a double pipe configuration of inner and outer tubes, between which partitioned passages for the flow of cooling fluid are formed, anti the outlet and an exhaust pipe connected to the muffler is joined by a joint member.

In accordance with the fifth aspect of the invention, the hydroplane having the above third feature is characterized in that the exhaust pipe has a double pipe configuration of inner and outer tubes, between which partitioned passages for the flow of cooling fluid are formed.

In accordance with the sixth aspect of the invention, the hydroplane having the above fourth feature is characterized in that the exhaust pipe has a double pipe configuration of inner and outer tubes, between which partitioned passages for the flow of cooling fluid are formed.

In accordance with the seventh aspect of the invention, the hydroplane having the above third feature is characterized in that the joint member is configured by drawing process.

In accordance with the eighth aspect of the invention, the hydroplane having the above fourth feature is characterized in that the joint member is configured by drawing process.

In accordance with the ninth aspect of the invention, the hydroplane having the above third feature is characterized in that the joint member has a double wall configuration of inner and outer walls, between which partitioned passages for the flow of cooling fluid are formed.

In accordance with the tenth aspect of the invention, the hydroplane having the above fourth feature is characterized in that the joint member has a double wall configuration of inner and outer walls, between which partitioned passages for the flow of cooling fluid are formed.

In accordance with the eleventh aspect of the invention, the hydroplane having the above seventh feature is characterized in that the joint member has a double wall configuration of inner and outer walls, between which partitioned passages for the flow of cooling fluid are formed.

In accordance with the twelfth aspect of the invention, the hydroplane having the above eighth feature is characterized in that the joint member has a double wall configuration of inner and outer walls, between which partitioned passages for the flow of cooling fluid are formed.

In accordance with the first feature of the invention, since a multicylinder engine is used, it is possible to achieve effective exhaust gas treatment compared to the case where a two-cycle engine is used. Further, since multiple exhaust manifold pipes are put together at their downstream end to form a single outlet, the exhaust-pulse scavenging pressure generated from one of the cylinders can be used to displace the remaining burned gases from the interior of the other cylinders to the outside thereof.

In accordance with the second feature of the invention, problems with temperature rise can be effectively eliminated by introducing cooling fluid to flow passages in the exhaust manifold pipes so as to cool the inner and outer tubes of the exhaust manifold pipes.

In accordance with the third and fourth features of the invention, since a single exhaust pipe can be used to connect the joint pipe with the muffler, this makes it possible to simplify the configuration, reduce the cost and weight.

In accordance with the fifth and sixth features of the invention, problems with temperature rise can be effectively eliminated by introducing cooling fluid to flow passages in the exhaust pipe so as to cool the inner and outer tubes of the exhaust pipe.

In accordance with the seventh and eighth features of the invention, instead of configuring joint members by a casting such as an aluminum casting which tends to result in increasing thickness, the joint members are fabricated by plastic deformation, i.e., drawing, cutting and bending of sheet metal, so it becomes possible to produce a thin-walled joints. Further, the shape of the multiple exhaust manifold pipes can be designed freely.

In accordance with the ninth through twelfth features of the invention, problems with temperature rise can be effectively eliminated by introducing cooling fluid to flow passages in the joint member so as to cool the inner and outer walls of the joint member.

DESCRIPTION OF THE PREFERRED EMBODIMENTS

Figure 2:
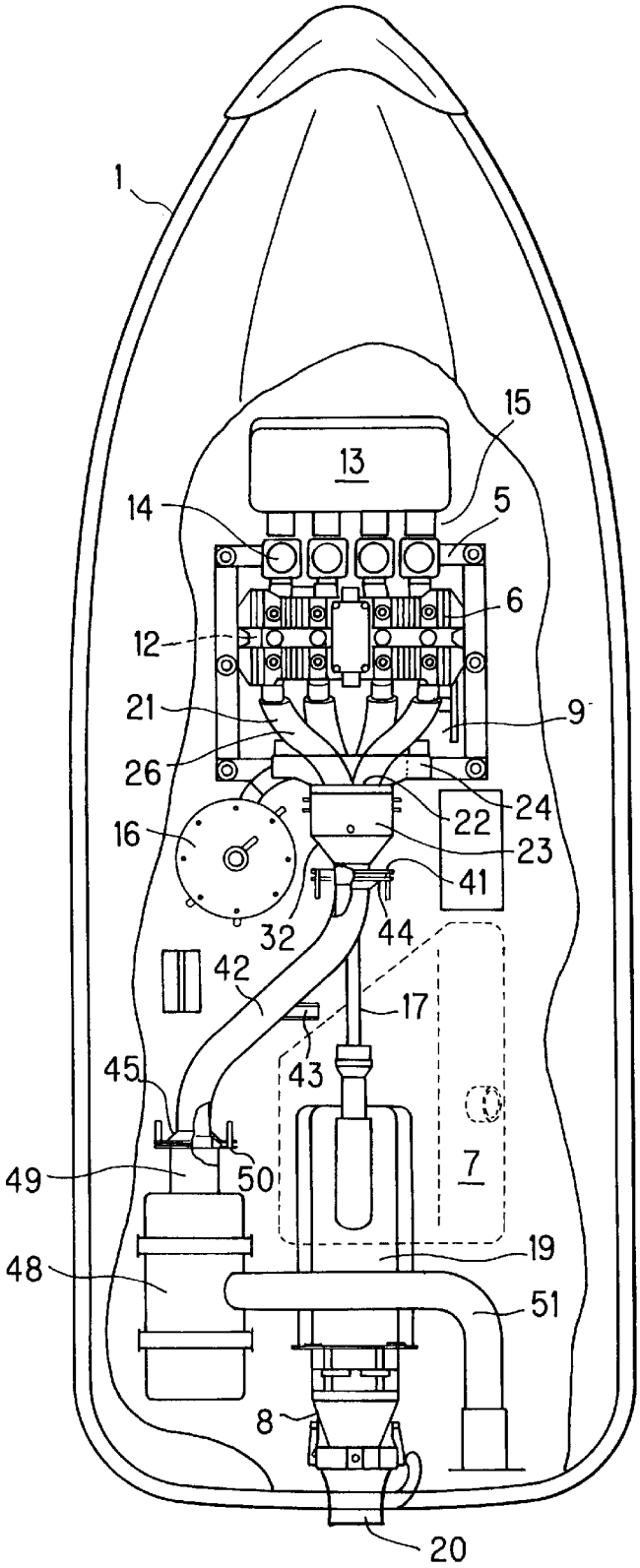
FIG. 2 is a sectional plan view showing the embodiment of a hydroplane in accordance with the invention.

The embodiment of the invention will hereinafter be described in detail with reference to the accompanying drawings. As seen in FIG. 2, the hydroplane in this embodiment comprises: a hull 1; a water-cooled, four-cylinder, four-cycle engine 6 and a jet pump 8 arranged fore and aft with respect to each other in the hull; a plurality of exhaust manifold pipes 21 connected at their upstream end to individual exhaust ports of the cylinders of four-cylinder engine 6 and connected at their downstream end forming an outlet 22, to a joint pipe 23, which is in turn is connected to an exhaust pipe 42 which is connected to a muffler 48.

Hull 1 is integrally formed by synthetic resins, and it has steering handlebars 2 rotatably attached at an upper central site nearer to the front, a strapped-on seat 3 in the upper rear portion and a pair of foot rests integrally formed therewith, on both sides of seat 3, so that an unillustrated rider can straddle seat 3 and control steering handlebars 2 as desired to thereby drive the craft skimming-wise over the water surface.

The structure of hull 1 is configured so as to take into account, directional stability, the inhibition of reaction force, etc. and has an engine room at a site displaced forward of the interior central portion to some degree. A large-sized in-line four cylinder engine 6 is mounted in an upright manner in the engine room via a plurality of rubber mounting pieces 4 and a box-like mounting frame 5. Provided to some degree in the rear part of the interior central portion of hull 1 is a fuel tank 7 for supplying fuel to four-cylinder engine 6 while a jet pump 8 is placed and oriented in the longitudinal direction of hull 1, in a pump room near the rear portion of the interior center.

Figure 1:
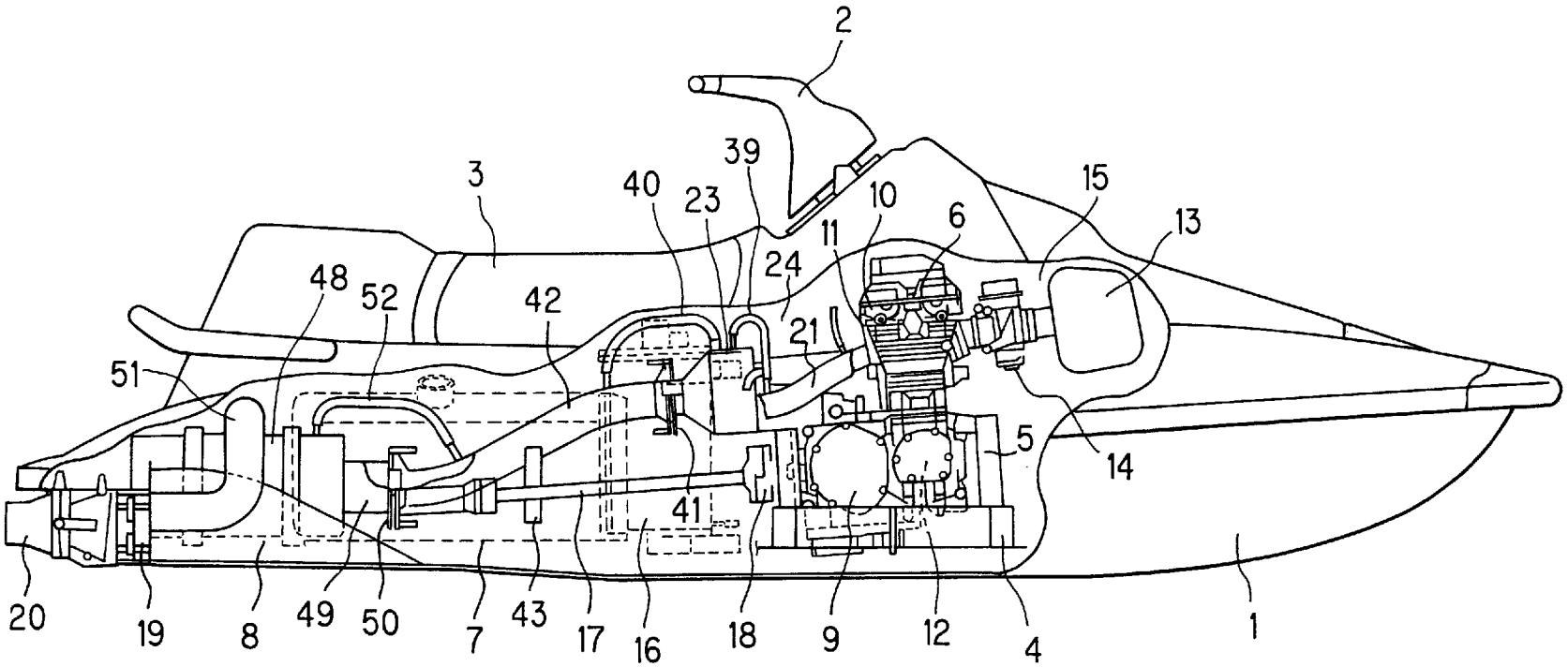
FIG. 1 is a sectional side view showing the embodiment of a hydroplane in accordance with the invention.

The engine room is configured so that air is drawn through a multiple number of unillustrated air ducts. Four-cylinder engine 6, as shown in FIGS. 1 and 2, has a crankcase 9 in the lower part thereof and a cylinder bloc disposed above the crankcase, composed of cylinders 11 arranged in an upright manner and cylinder heads 10. A crankshaft 12 is provided inside crankcase 9, extending transversely across hull 1 and being rotatably supported by a plurality of bearings. This crankshaft 12 is linked via bevel gears with an unillustrated power-direction varying mechanism inside crankcase 9. This power-direction varying mechanism transmits the rotational power from crankshaft 12, changing the power direction by 90° as well as reducing the speed of rotation.

Accordingly, four-cylinder engine 6 is of a transversally mounted in-line type, i.e., cylinders 11 being arranged transversely across hull 11, instead of a lengthwise mounted type as in conventional configurations. Mounted in the forwards upper portion above the center line of crankshaft 12 is an intake system 15 of an air box 13 and carburetor 14 while an oil tank 16 for oil lubrication, connected to four-cylinder engine 6 via an oil pipe is mounted on one side in the rear of the central line of crankshaft 12. Thus, the relatively ample room in respect to the lengthwise direction is markedly more efficiently used.

As shown in FIGS. 1 and 2, jet pump 8 has an impeller shaft 17 of stainless steel, positioned on a slant along the central line of hull 1. This impeller shaft 17 is joined to the shaft of power-direction varying mechanism through a coupling 18 made up of rubber. Fitted to the end of impeller shaft 17 is an impeller rotating inside a casing 19 so that the rotation of this impeller sucks water from an unillustrated opening in hull 1 to eject the water rearward from a nozzle 20.

Cylinders 11 are arranged approximately perpendicular to the center line of impeller shaft 17. A stator (not shown) is fixed inside casing 19. Nozzle 20 is adapted to sway in accordance with steering control from steering handlebars 2, so that this swaying enables the steering of the hydroplane to be effected. Further, a cooling water inlet port (not shown) is provided on the ejection side of jet pump 8 so that cooling water is supplied from this cooling water inlet port to multiple exhaust manifold pipes 21.

Multiple exhaust manifold pipes 21 (four in this embodiment) are of almost the same length as shown FIGS. 1 through 4 and are located to the rear of crankshaft 12 and are curvingly connected to the exhaust ports of individual cylinder heads 10 of cylinders 11, and their downstream ends are joined together above crankcase 9 to form a single outlet 22, which passes through and is connected with joint pipe 23. Multiple exhaust manifold pipes 21, together with joint pipe 23, constitute an exhaust system 24, and are supported by mounting frame 5 and are located above crank case 9.

Each exhaust manifold pipe 21 has a coaxial double-pipe configuration of a longer, inner tube 25 and a relatively shorter, outer tube 26 with a jacket 27 partitioned into sections for the flow of cooling water, formed between the two tubes. Outer tube 26 has nipples 28 at both up- and down-stream ends thereof, and is connected at its upstream end to a cooling water inlet pipe 29 and at its downstream end is connected to a cooling water outlet pipe 30.

Figure 3:
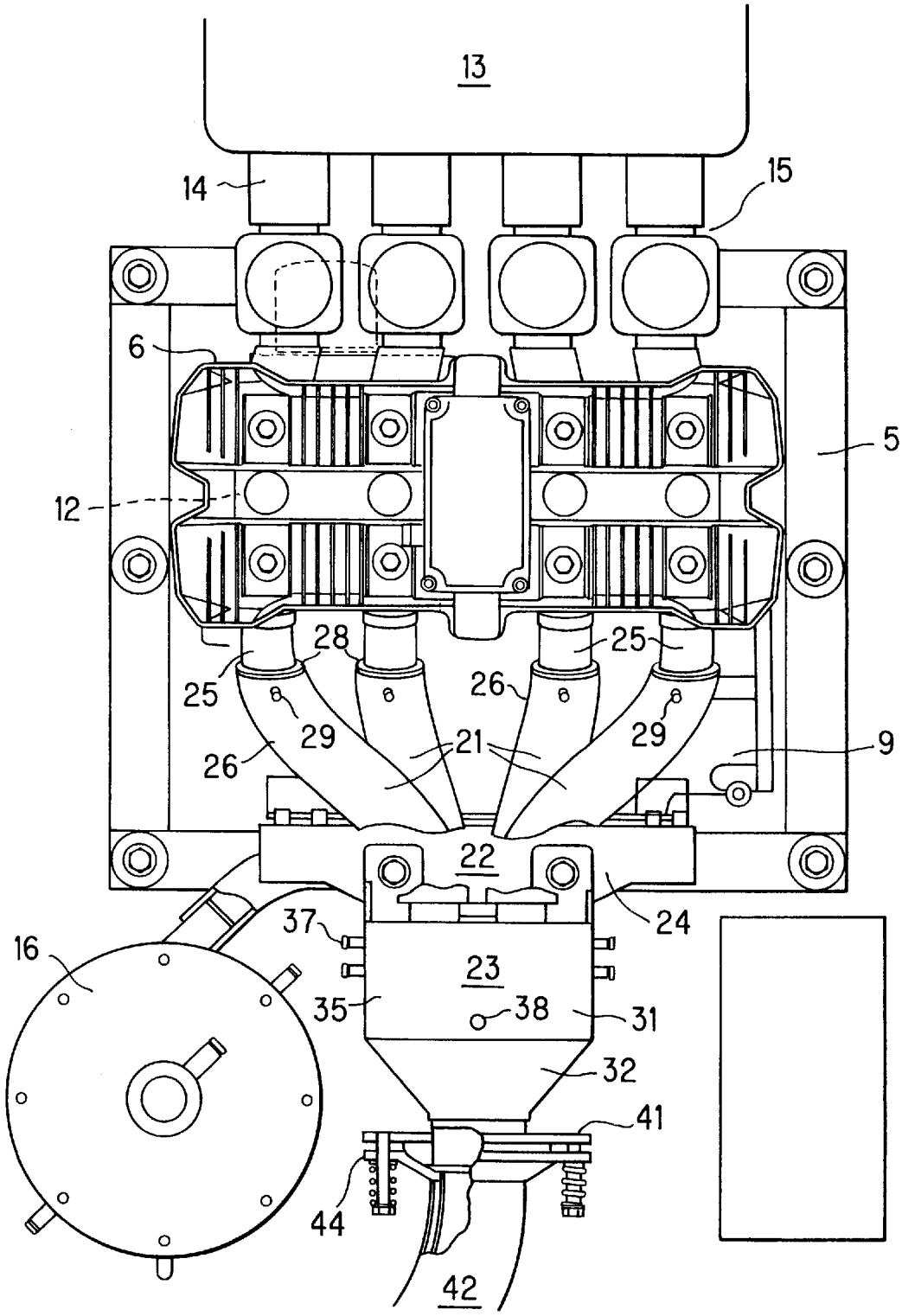
FIG. 3 is a partially enlarged view for illustrating the embodiment of a hydroplane in accordance with the invention.
Figure 4:
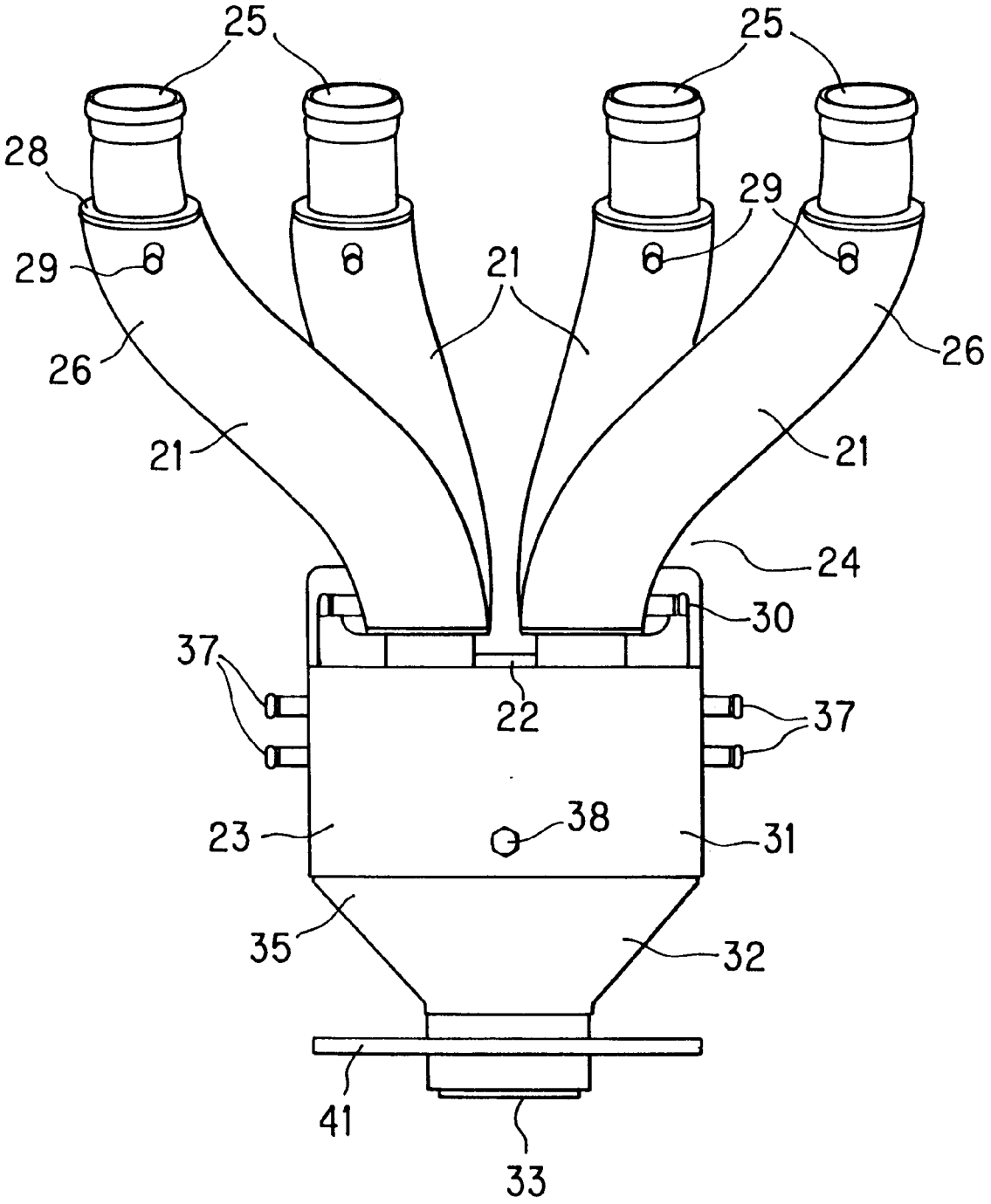
FIG. 4 is a front view showing exhaust manifold pipes and a joint assembly in the embodiment of a hydroplane in accordance with the invention.
Figure 5:
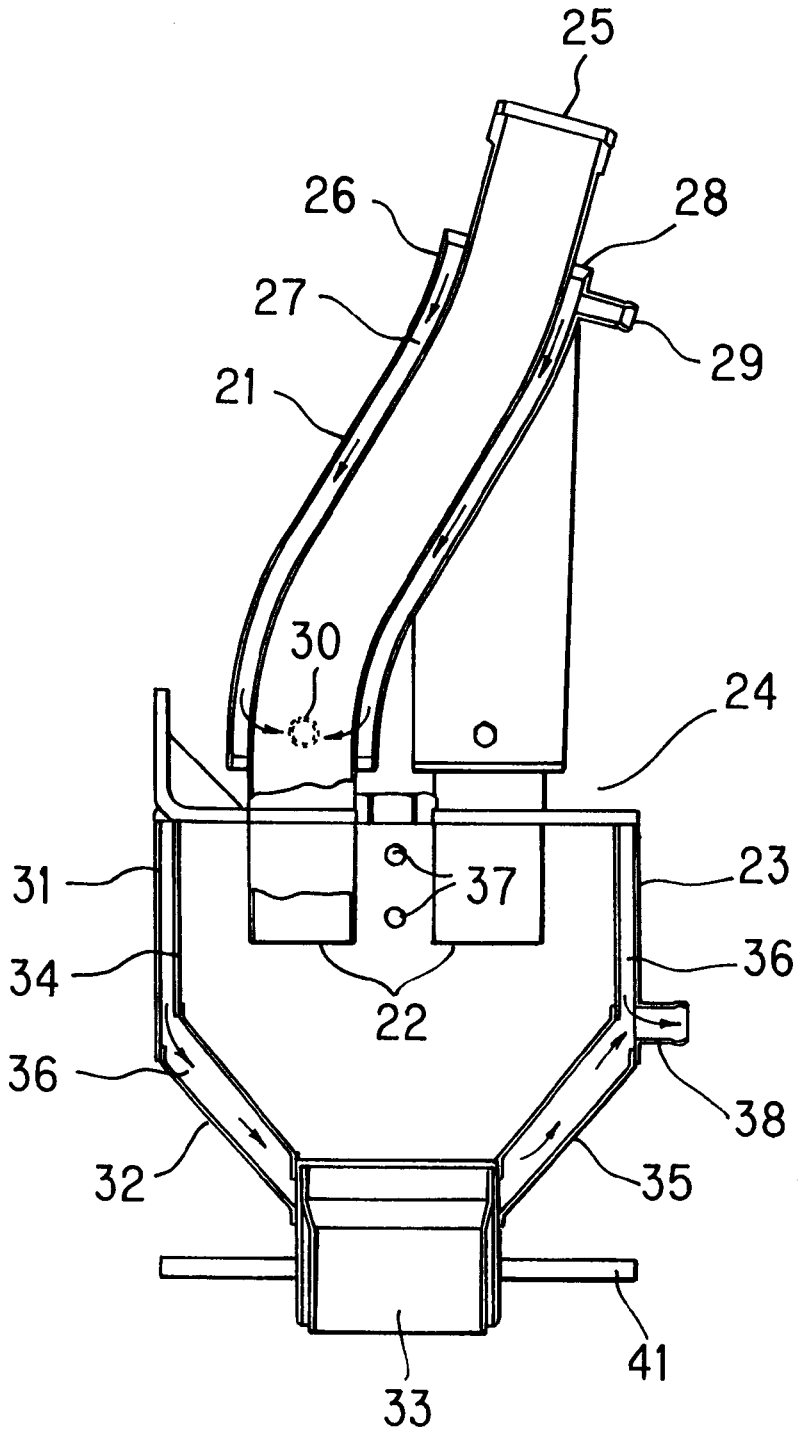
FIG. 5 is a sectional illustrative view of FIG.3.

Joint pipe 23, as shown in FIGS.3 through 5, is integrally configured of a large-diametric cylinder portion 31 formed by drawing process for holding multiple exhaust manifold pipes 21 together and allowing them to pass therethrough, a tapered pipe portion 32 which decreases the cross section from the upstream to the downstream end, a small-diametric cylinder portion 33, and is supported by mounting frame 5 so as to be positioned above crankcase 9. Large-diametric pipe portion 31 and tapered pipe portion 32 are formed of a double-wall configuration which is made from an inner shell 34 and an outer shell 35, between which a jacket 36 partitioned into sections is formed for the flow of cooling water. A plurality of cooling water inlet pipes 37 are connected at upstream sites in outer shell 35 of large-diametric pipe portion 31 and a cooling water outlet pipe 38 is connected at a downstream site therein.

Multiple cooling water inlet pipes 37 are connected through communicating pipes 39 to cooling water outlet pipe 30 of exhaust manifold pipes 21. Cooling water outlet pipe 38 is connected to a cooling water inlet pipe 46 of exhaust pipe 42 via a communicating pipe 40. As seen in FIGS.3 and 4, small-diametric pipe portion 33 is fitted with an attachment joint 41, which is connected to another attachment joint 44 oil the upstream portion of exhaust pipe 42 with a spherical gasket and a clamp for resistance to vibration and shock.

Exhaust pipe 42 is formed so as to be flexed sidewards from the center of hull 1 and downwards, from the upstream to the downstream end, and is supported by a bracket 43 for vibration absorption. Attachment joint 44 for joint pipe 23 is fitted on the upstream end of exhaust pipe 42 while attachment joint 45 is fitted on the downstream end of exhaust pipe 42. This attachment joint 45 is joined to another attachment joint 50 in muffler 48 by means of a special gasket and clamp. Exhaust pipe 42 has a coaxial double-pipe configuration substantially similar to that of exhaust manifold pipe 21, and the space between the inner and outer tubes, in which an unillustrated catalyst is incorporated, forms a jacket partitioned into sections for the flow of cooling water. The outer pipe has nipples at both up- and downstream ends thereof, and is connected at its upstream end to a cooling water inlet pipe 46 and at its downstream end is connected to a cooling water outlet pipe 47.

Further, muffler 48 has multiple number of exhaust compartments (not shown) arranged from the upstream to the downstream end, and is located on one side in the rear of the interior of hull 1, as shown in FIG. 2. These multiple exhaust compartments are adapted to communicate with each other. A connecting tube 49 extending forwards with respect to hull 1 from the upstream exhaust compartment is formed with an attachment joint 50 for mating attachment joint 45 at the downstream end of exhaust pipe 42. Further, connected to the downstream exhaust compartment is an exhaust hose 51, which crosses over jet pump 8 and is bent in an approximately L-shape to the level of the pump to discharge the exhaust to the rear of the craft. Further, the upstream exhaust compartment is connected to cooling water output pipe 47 of exhaust pipe 42 via a communication pipe 52.

In this arrangement, when a rider straddling seat 3 starts four-cylinder engine 6, it powers jet pump 8 so as to drive the impeller at the predetermined speed. This impeller draws water from the opening of hull 1 to eject the water rearwards from nozzle 20. This effect of the jet of water produces a propulsion so that the hydroplane will skim over the water surface. During skimming, the exhaust gas is discharged from the exhaust port of four-cylinder engine 6, passing through, in order of sequence, exhaust manifold pipes 21, joint pipe 23, exhaust pipe 42, and muffler 48, and is exhausted to the outside of the craft from exhaust hose 51 at the stern of hull 1.

As four-cycle engine 6 starts, cooling water, from sea or lake water (indicated by arrows) flows into the cooling water input port, is supplied therefrom, passing through the communicating pipe, to jacket 27 of exhaust manifold pipes 21, jacket 36 of joint pipe 23, the jacket of exhaust pipe 42, in order of sequence, to thereby cool down all the heated elements, i.e., exhaust manifold pipes 21, joint pipe 23, exhaust pipe 42 and the catalyst. The cooling water used to cool exhaust manifold pipes 21, joint pipe 23, exhaust pipe 42 and the catalyst, flows from the jacket of exhaust pipe 42, passing through muffler 48, into exhaust hose 51, and then is discharged out of the craft.

In accordance with the above configuration, since four-cylinder engine 6 is used, the discharge of HCs is markedly reduced compared to that from a two-cycle engine, thus making it possible to achieve effective exhaust gas treatment. Further, since multiple exhaust manifold pipes 21 are put together at their downstream end above crankcase 9 to form a single outlet 22 using joint pipe 23, the exhaust-pulse scavenging pressure generated from one of the cylinders can be used to displace the remaining burned gases from the interior of the other cylinders 11 to the outside thereof. Accordingly, it is possible to remarkably improve the charging efficiency of intake air, and hence sharply improve the output power of engine 6. Further, since the connection of joint pipe 23 with muffler 48 can be configured as a single component i.e., by exhaust pipe 42, this makes it possible to simplify the configuration, reduce the cost and weight.

Differing from conventional configurations, joint pipe 23 of this embodiment is formed by drawing process, so that it can be of a thin-wall configuration, and therefore, it is possible to produce an extremely light-weight exhaust system, despite the provision of jacket 27. Further, since multiple exhaust manifold pipes 21 can be shaped in a free manner, it is possible to simplify the configuration, reduce the cost and weight as well as improving the design flexibility and hence a marked improvement of the performance of four-cylinder engine 6 can be expected. As stated heretofore, even the use of a four-cycle engine 6 can provide a markedly simple configuration of a light-weight, compact exhaust system. Further, since cylinders 11 are arranged approximately perpendicular to the center line of impeller shaft 17, it is possible to dispose intake system 15 and exhaust system 24 in a straight line. Resultantly, it is possible to reduce the intake and exhaust resistance as well as to markedly improve the charging efficiency of the intake air and the exhaust efficiency.

Although the above embodiment has been illustrated with the case of four-cylinder engine 6, the invention should not be limited to this. For example, an engine of two cylinders, three cylinders or five or more cylinders can be used. Further, crankshaft 12 may be oriented in the longitudinal direction of hull 1. The number of exhaust manifold pipes 21, and/or the number of support brackets 43 as well as the number of catalysts can be increased or decreased as appropriate. The length of multiple exhaust manifold pipes 21 can be varied as appropriate. Other cooling fluids can be used as appropriate. Exhaust manifold pipes 21 and/or joint pipe 23 may be supported by crankcase 9. Joint pipe 23 may be formed of a double pipe configuration.

Joint between pipes can be formed as appropriate of a screwed type, butt welding type, socket welding type, bite type, flare type, etc. It is of course possible to provide either a single cooling fluid ejecting hole or a plurality of ejecting holes, for inner tube 25 and inner shell 34 in which jacket 27 and 36 are formed in a partitioned manner.

As has been described heretofore, in accordance with the first aspect of the invention, it is possible to configure a light-weight, compact exhaust system even when a four-cycle engine is used.

In accordance with the second, fifth, sixth and ninth through twelfth aspects of the invention, problems with temperature rise can be effectively eliminated by the use of cooling fluid.

In accordance with the third and fourth aspects of the invention, since a single exhaust pipe can be used to connect the joint pipe with the muffler, it is possible to simplify the configuration and reduce the cost and weight.

Further, in accordance with the seventh and eighth aspects of the invention, the use of a drawing process configuration facilitates free design and setup of the shape of the exhaust manifold pipes as well as being effective in forming the joint member with a thin-wall configuration.

What is claimed is:

1. A hydroplane comprising a four cycle, multicylinder engine and a jet pump mounted in the hull to propel itself by running the engine to power the jet pump, said engine being transversely mounted within the hull of the hydroplane and including a crankcase, crankshaft and cylinders, the cylinders each having an individual exhaust manifold pipe connected to an exhaust port of each cylinder and extending rearwardly of the crankshaft from the exhaust ports, the multiple exhaust manifold pipes being coupled together at the downstream end above the crankcase to form a single outlet.

2. The hydroplane according to claim 1, wherein each of the exhaust manifold pipes has a double pipe configuration of inner and outer tubes, between which partitioned passages for the flow of cooling fluid are formed.

3. The hydroplane according to claim 1, wherein the outlet and an exhaust pipe connected to a muffler are joined by a joint member.

4. The hydroplane according to claim 2, wherein the outlet and an exhaust pipe connected to a muffler are joined by a joint member.

5. The hydroplane according to claim 3, wherein the exhaust pipe has a double pipe configuration of inner and outer tubes,; between which partitioned passages for the flow of cooling fluid are formed.

6. The hydroplane according to claim 4, wherein the exhaust pipe has a double pipe configuration of inner and outer tubes, between which partitioned passages for the flow of cooling fluid are formed.

7. The hydroplane according to claim 3, wherein the joint member is configured by drawing process.

8. The hydroplane according to claim 4, wherein the joint member is configured by drawing process.

9. The hydroplane according to claim 3, wherein the joint member has a double wall configuration of inner and outer walls, between which partitioned passages for the flow of cooling fluid are formed.

10. The hydroplane according to claim 4, wherein the joint member has a double wall configuration of inner and outer walls, between which partitioned passages for the flow of cooling fluid are formed.

11. The hydroplane according to claim 7, wherein the joint member has a double wall configuration of inner and outer walls, between which partitioned passages for the flow of cooling fluid are formed.

12. The hydroplane according to claim 8, wherein the joint member has a double wall configuration of inner and outer walls, between which partitioned passages for the flow of cooling fluid are formed.

* * * * *